US011414968B2

(12) United States Patent
Al-Muraikhi

(10) Patent No.: US 11,414,968 B2
(45) Date of Patent: Aug. 16, 2022

(54) METHOD AND SYSTEM FOR SUBSURFACE TO SUBSURFACE WATER INJECTION

(71) Applicant: SAUDI ARABIAN OIL COMPANY, Dhahran (SA)

(72) Inventor: Abdullah Ibrahim Al-Muraikhi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/083,954

(22) Filed: Oct. 29, 2020

(65) Prior Publication Data

US 2022/0136375 A1 May 5, 2022

(51) Int. Cl.
*E21B 43/12* (2006.01)
*E21B 47/113* (2012.01)
(Continued)

(52) U.S. Cl.
CPC ..... *E21B 43/128* (2013.01); *E21B 34/06* (2013.01); *E21B 43/20* (2013.01); *E21B 43/385* (2013.01);
(Continued)

(58) Field of Classification Search
CPC ..... E21B 43/128; E21B 43/38; E21B 43/385; E21B 43/40; E21B 34/06; E21B 43/20;
(Continued)

(56) References Cited

U.S. PATENT DOCUMENTS 4,766,957 A * 8/1988 McIntyre ..... E21B 43/385 166/106
5,730,871 A * 3/1998 Kennedy ..... B01D 17/0217 166/265
6,033,567 A * 3/2000 Lee ..... B01D 17/0217 166/265
(Continued)

FOREIGN PATENT DOCUMENTS

CN 202745838 U 2/2013
CN 204532297 U 8/2015
(Continued)

OTHER PUBLICATIONS

Tarabelli, Mauro Luis et al., "Experience With Inverted ESP for Water Injection in Secondary Recovery Project", SPE-173980-MS, Society of Petroleum Engineers, May 2015 (20 pages).
(Continued)

*Primary Examiner* — Brad Harcourt
(74) *Attorney, Agent, or Firm* — Osha Bergman Watanabe & Burton LLP

(57) ABSTRACT

A submersible pump system may include a perforated casing lining a wellbore adjacent to a first formation and a second formation. Additionally, a production tubing may be hanging in the wellbore to extend past the first formation and into the second formation to form a fluid conduit from a surface to the second formation. Further, an electrical submersible pump may be coupled to the production tubing and be oriented upside-down to have one or more fluid intakes at an upper end of the electrical submersible pump and one or
(Continued)

more fluid outlets at a lower end of the electrical submersible pump. The electrical submersible pump may be positioned downhole in the wellbore between the first formation and the second formation. The upside-down electrical submersible pump may be configured to extract fluid from the first formation and inject the extracted fluid into the second formation with the production tubing.

19 Claims, 10 Drawing Sheets

(51) Int. Cl.

| | |
|---|---|
| ***E21B 34/06*** | (2006.01) |
| ***E21B 43/20*** | (2006.01) |
| ***E21B 43/38*** | (2006.01) |
| ***E21B 47/10*** | (2012.01) |
| ***F04B 17/03*** | (2006.01) |
| ***F04B 47/06*** | (2006.01) |
| ***F04B 49/02*** | (2006.01) |
| ***F04B 49/06*** | (2006.01) |
| *E21B 33/12* | (2006.01) |

(52) U.S. Cl.
CPC ..... *E21B 47/10* (2013.01); *E21B 47/113* (2020.05); *F04B 17/03* (2013.01); *F04B 47/06* (2013.01); *F04B 49/02* (2013.01); *F04B 49/06* (2013.01); *E21B 33/12* (2013.01)

(58) Field of Classification Search
CPC ..... E21B 47/10; E21B 47/113; E21B 33/12; F04B 17/03; F04B 47/06; F04B 49/02; F04B 49/06
See application file for complete search history.

(56) References Cited

U.S. PATENT DOCUMENTS

| | | | | |
|---|---|---|---|---|
| 6,082,452 | A * | 7/2000 | Shaw | B04C 5/00 166/105.5 |
| 6,131,655 | A * | 10/2000 | Shaw | E21B 43/12 166/105.5 |
| 6,382,316 | B1 * | 5/2002 | Kintzele | E21B 43/385 166/105.5 |
| 9,500,073 | B2 | 11/2016 | Xiao et al. | |
| 2008/0236821 | A1 * | 10/2008 | Fielder | E21B 43/385 166/265 |
| 2009/0014171 | A1 * | 1/2009 | Woie | E21B 43/385 166/105.5 |
| 2015/0159472 | A1 * | 6/2015 | Wolf | E21B 43/08 166/313 |
| 2020/0248541 | A1 | 8/2020 | Rabba et al. | |

FOREIGN PATENT DOCUMENTS

| | | | |
|---|---|---|---|
| CN | 205013319 | U | 2/2016 |
| CN | 206487451 | U | 9/2017 |
| CN | 105156340 | B | 8/2018 |
| WO | 98/13579 | A2 | 4/1998 |
| WO | 01/49973 | A1 | 7/2001 |

OTHER PUBLICATIONS

Anthony E. et al: "Inverted ESP Changing the Game in Water Coning Control in Water Drive Reservoirs—North Kuwait Case Study" Day 3 Wed, Oct. 11, 2017, Oct. 9, 2017, pp. 1-16, XP055890315 (16 pages).

International Search Report and Written Opinion of the International Searching Authority issued in corresponding International Application No. PCT/US2021/057246 dated Feb. 23, 2022 (19 pages).

* cited by examiner

METHOD AND SYSTEM FOR SUBSURFACE TO SUBSURFACE WATER INJECTION

BACKGROUND

Fluids are typically produced from a reservoir in a formation by drilling a wellbore into the formation, establishing a flow path between the reservoir and the wellbore, and conveying the fluids from the reservoir to the surface through the wellbore. Typically, a production tubing is disposed in the wellbore to carry the fluids to the surface. The production tubing may include a pump to assist in lifting the fluids up the wellbore. Fluids produced from a hydrocarbon reservoir may include natural gas, oil, and water. Various artificial lift technologies may be used in the oil and gas industry to increase fluid production and recovery from wells that lack sufficient internal pressure for natural production. These technologies, based on their lifting mechanisms, may be grouped as mechanical (suck rod or beam pump, progressive cavity pump, hydraulic piston pump), hydraulic (velocity string, gas lift, plunger lift, jet pump), electromechanical (electric submersible pump, electric submersible progressive pump), and chemical (surfactant, soap sticks). An electrical submersible pump (ESP) generally includes a centrifugal pump, a motor, an electrical power cable connected to the motor, and surface controls (switchboards/variable speed drives). The centrifugal pump, the seal chamber, and the motor are usually hung on tubing or pipe known as a production tubing string from a wellhead with the pump located axially above the motor; however, in certain applications, the motor may be located above the pump.

FIG. 1 shows a conventional completion well system 10 for producing hydrocarbons according to one illustrative implementation. For illustration purposes, subterranean formations 1, 2, 3 are shown below a surface 4. In general, there may be many layers of subterranean formations below the surface 4. For illustration purposes, formations 1, 2, 3 may be carbonate formations. In one example, formation 3 is a target reservoir 5 containing hydrocarbons to be produced. A wellbore 6, which is connected to the surface 4, may be drilled through the subterranean formations 1, 2, 3 to reach to the target reservoir 5. A casing 7 may be installed in wellbore 6. In some embodiments, the casing 7 may be perforated to have perforations 8 into the target reservoir 5 to allow a flow of hydrocarbons to enter the wellbore 6.

The conventional completion well system 10 may also include a production tubing 9 extending into the wellbore 6 from a wellhead 18 at the surface 4. The production tubing 9 extends past the target reservoir 5, thereby forming a flow conduit from the target reservoir 5 to surface 4. The production tubing 9 may include a pump 11 suspended in the wellbore 6 from a bottom of the production tubing 9 to a location near the perforations 8. Multiple pumps 11 may be installed in the production tubing 9. The target reservoir 5 may be isolated by one or more packers or plugs 12 sealing an annulus 13 between the production tubing 9 and the casing 7 from a bottom 14 of the wellbore 6. Once the target reservoir 5 is isolated, the pump 11 may be operated to retrieve fluids from the target reservoir 5, increase the pressure of the fluids, and discharge the pressurized fluids into the production tubing 9. Pressurized fluid in the production tubing 9 rises to the surface due to differences in pressure. Further, a fluid system 16 may be provided on the surface 4 to pump fluids in or out of the wellbore 6. In addition, a power system 17 may be coupled to the wellhead 18 at the surface 4 to provide power to various components of the conventional completion well system 10 on the surface 4 and within the wellbore 6.

As shown in FIG. 2, the pump 11 may be a downhole electric submersible pump (ESP) positioned in a wellbore 6. The ESP 11 includes a motor 20, a motor seal 25, a gas separator 30, and a pump 40. The gas separator 30 is positioned between the pump 40 and the motor seal 25. The motor 20 is adapted to drive the gas separator 30 and the pump 40. A central shaft extends from the motor 20 and through the motor seal 25 for engaging a central shaft of the separator 30 and a central shaft of the pump 40. Fluid enters the ESP 11 through the intake port 32 in the lower end of the gas separator 30. The fluid is separated by an internal rotating member with blades attached to the shaft of the gas separator 30. The gas separator 30 may also have an inducer pump or auger at its lower end to aid in lifting the fluid to the blades. Centrifugal force created by the rotating separator member causes denser fluid (i.e. fluid having more liquid content) to move toward the outer wall of the gas separator 30. The fluid mixture then travels to the upper end of gas separator 30 toward a flow divider in the gas separator. The flow divider is adapted to allow the denser fluid to flow toward the pump, while diverting the less dense fluid to the exit ports 38 of the gas separator 30. Gas leaving the gas separator 30 travels up the annulus 13.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a submersible pump system. The submersible pump system may include a perforated casing lining a wellbore adjacent to a first formation and a second formation. The first formation may be above the second formation. Additionally, a production tubing may be hanging in the wellbore. The production tubing may extend past the first formation and into the second formation to form a fluid conduit from a surface to the second formation. Further, an electrical submersible pump may be coupled to the production tubing. The electrical submersible pump may be oriented upside-down to have one or more fluid intakes at an upper end of the electrical submersible pump and one or more fluid outlets at a lower end of the electrical submersible pump. The electrical submersible pump may be positioned downhole in the wellbore between the first formation and the second formation. The upside-down electrical submersible pump may be configured to extract fluid from the first formation and inject the extracted fluid into the second formation with the production tubing.

In another aspect, embodiments disclosed herein relate to a method. The method may include lowering a production tubing into a wellbore to extend past a first formation and into a second formation below the first formation to form a fluid conduit from a surface to the second formation. Additionally, the method may include positioning an electrical submersible pump, coupled to the production tubing, between the first formation and the second formation, wherein the electrical submersible pump is oriented upside-down. The method may also include providing a suction force, with the electrical submersible pump, to extract fluid into the production tubing from the first formation. The method may further include pumping the extracted fluid, with the electrical submersible pump, down the production tubing. Furthermore, the method may include injecting the extracted fluid, with the electrical submersible pump, into the second formation from the production tubing.

In yet another aspect, embodiments disclosed herein relate to a non-transitory computer readable medium storing instructions on a memory coupled to a processor. The instructions may include obtaining flow rate measurements of a fluid being extracted from a first formation with an upside-down oriented electrical submersible pump positioned within a wellbore between the first formation and a second formation. The instructions may further include determining, using the flow rate measurements, an amount of the extracted fluid being injected into the second formation with the electrical submersible pump. The processor may be configured to continue operating the electrical submersible pump until the amount of the fluids being injected reaches a required volume. Further, the processor may also be configured to turn off the electrical submersible pump once the required volume is reached.

Other aspects and advantages of the invention will be apparent from the following description and the appended claims.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, shapes of the elements as drawn are not necessarily intended to convey any information regarding the actual shape of the elements and have been solely selected for ease of recognition in the drawing.

DETAILED DESCRIPTION

Figure 1:
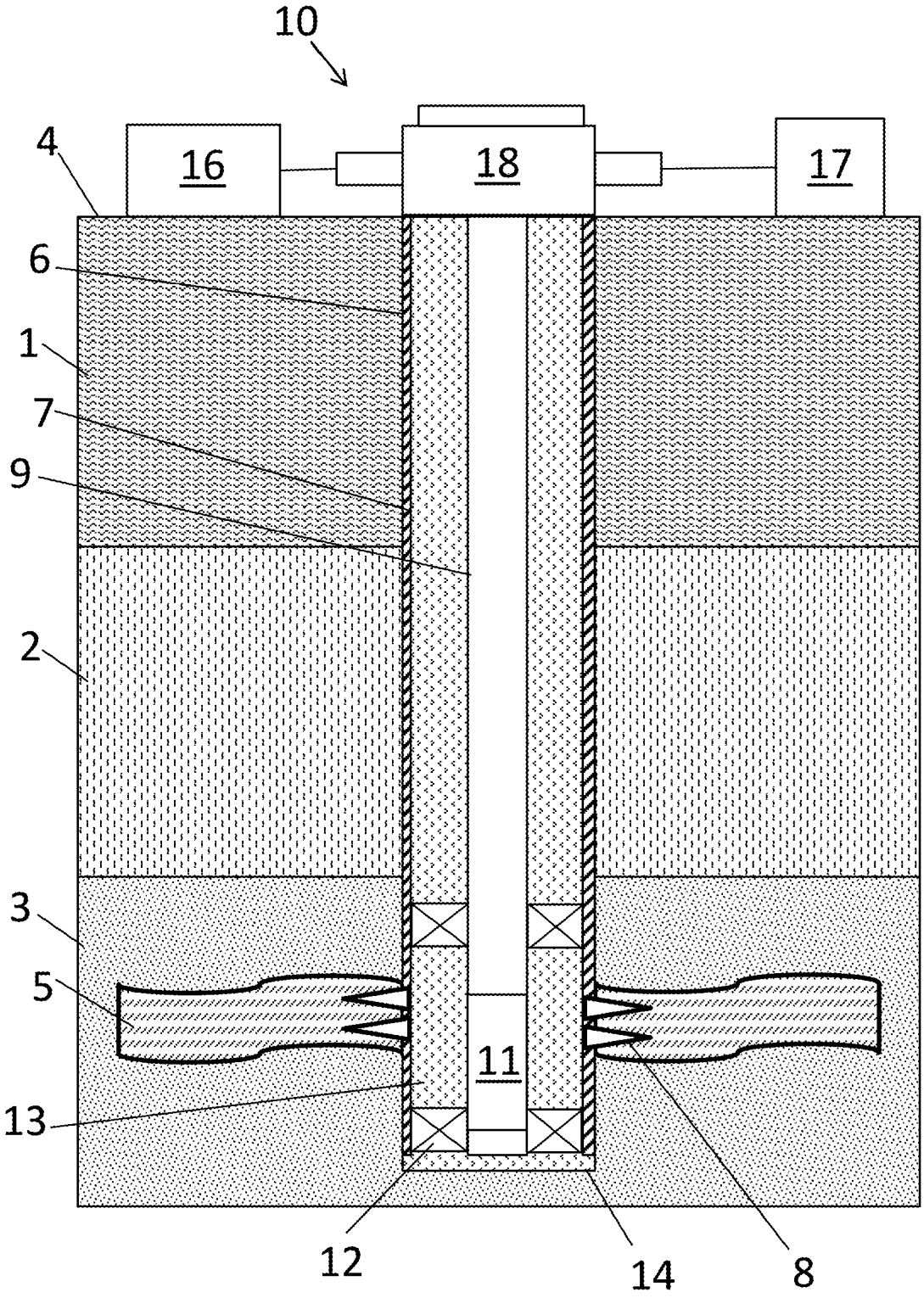
FIG. 1 (PRIOR ART)
FIG. 1 is a schematic diagram of a completion well system in accordance with prior art.
Figure 2:
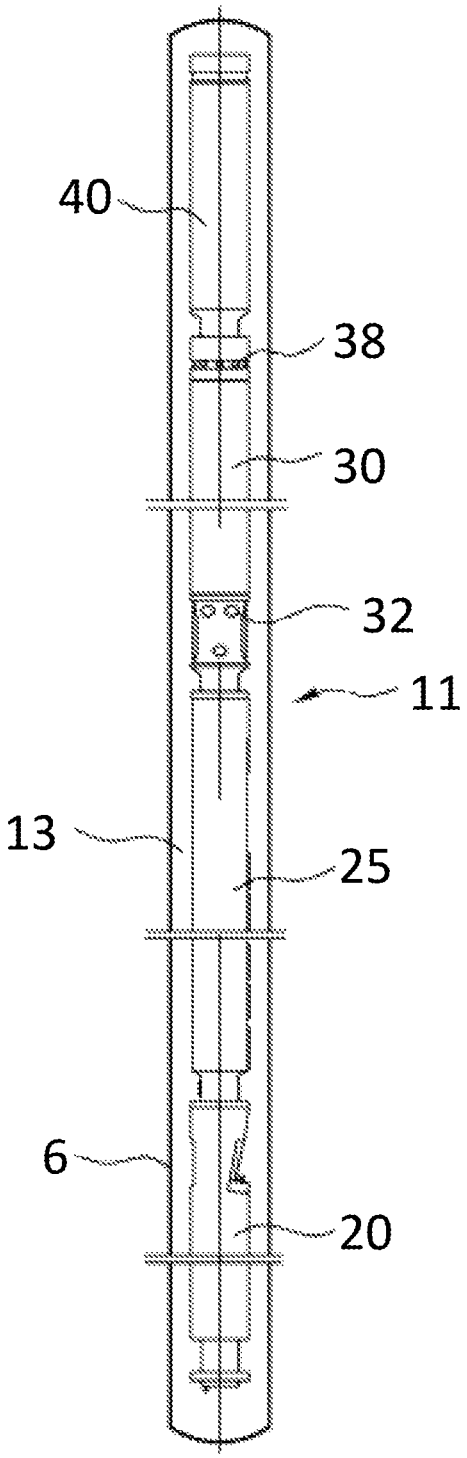
FIG. 2 (PRIOR ART)
FIG. 2 is a schematic diagram of an electrical submersible pump (ESP) in accordance with prior art.

In the following detailed description, certain specific details are set forth to provide a thorough understanding of various disclosed implementations and embodiments. However, one skilled in the relevant art will recognize that implementations and embodiments may be practiced without one or more of these specific details, or with other methods, components, materials, and so forth. For the sake of continuity, and in the interest of conciseness, same or similar reference characters may be used for same or similar objects in multiple figures. As used herein, the term "coupled" or "coupled to" or "connected" or "connected to" "attached" or "attached to" may indicate establishing either a direct or indirect connection, and is not limited to either unless expressly referenced as such. As used herein, fluids may refer to slurries, liquids, gases, and/or mixtures thereof. It is to be further understood that the various embodiments described herein may be used in various stages of a well (land and/or offshore), such as rig site preparation, drilling, completion, abandonment etc., and in other environments, such as work-over rigs, fracking installation, well-testing installation, oil and gas production installation, without departing from the scope of the present disclosure.

Embodiments disclosed herein are directed to submersible pump systems to extract fluids from a subterranean formation and inject the fluids into another subterranean formation within a well. More specifically, embodiments disclosed herein are directed to a submersible pump to pull the fluids from one subterranean formation and inject the fluids further down the well into another subterranean formation different from the subterranean formation from which the fluids are extracted. The different embodiments described herein may provide a submersible pump system between two subterranean formations for fluid injection that plays a valuable and useful role in the life of a well. By using the submersible pump system for fluid injection operations, the submersible pump system may eliminate the need for a wellhead and other costly surface facilities conventionally used in fluid injection operations.

Further, a configuration and arrangement of the submersible pump system to extract and inject fluids from one subterranean formation to another subterranean formation within a well according to one or more embodiments described herein may provide a cost-effective alternative to conventional injection systems. For example, one or more embodiments described herein may eliminate the need for a wellhead and other costly surface facilities conventionally used in fluid injection operations. The embodiments disclosed herein are described merely as examples of useful applications, which are not limited to any specific details of the embodiments herein.

In accordance with one or more embodiments, a submersible pump system includes a submersible pump in a wellbore. In one or more embodiments, the submersible pump may be an electric submersible pump (ESP), or any type of downhole pump, positioned to provide a suction force to pull fluids in and then inject the fluids further downhole. Further, one or more flowmeters may be adjacent to the submersible pump to measure, monitor, and transmit flow rates of the submersible pump to a surface control system.

Injection methods in the oil and gas industry typically require large and costly surface equipment with an extensive layout and arrangement of pipes along with high surface pressure. Such conventional injection methods may also be more expensive because of the higher number of parts and components along with design and installation costs. Additionally, conventional injection methods need a fluid source at surface, such as a tank containing fluids. The fluids in the tank may be seawater or treated fluids which involves costly desalination or chemical treatments to reduce contamination to reach an acceptable concentration for injection into a subterranean formation.

Advantageously, the submersible pump system disclosed herein may move fluids without requiring surface equipment such as fluid tanks, fluid pumps, and other equipment used in typical fluid injection operations. Moreover, because the operation of the submersible pump system occurs fully underground and may be isolated with plugs, the disclosed injection method may have zero wellhead pressure. Overall, the submersible pump system may minimize product engineering, risk associated with surface equipment, reduction of assembly time, hardware cost reduction, and weight and envelope reduction. Thus, the disclosed subsurface to subsurface fluid injection methods using the submersible pump system improves safety on site and reduces cost associated with conventional fluid injection operations.

Figure 3:
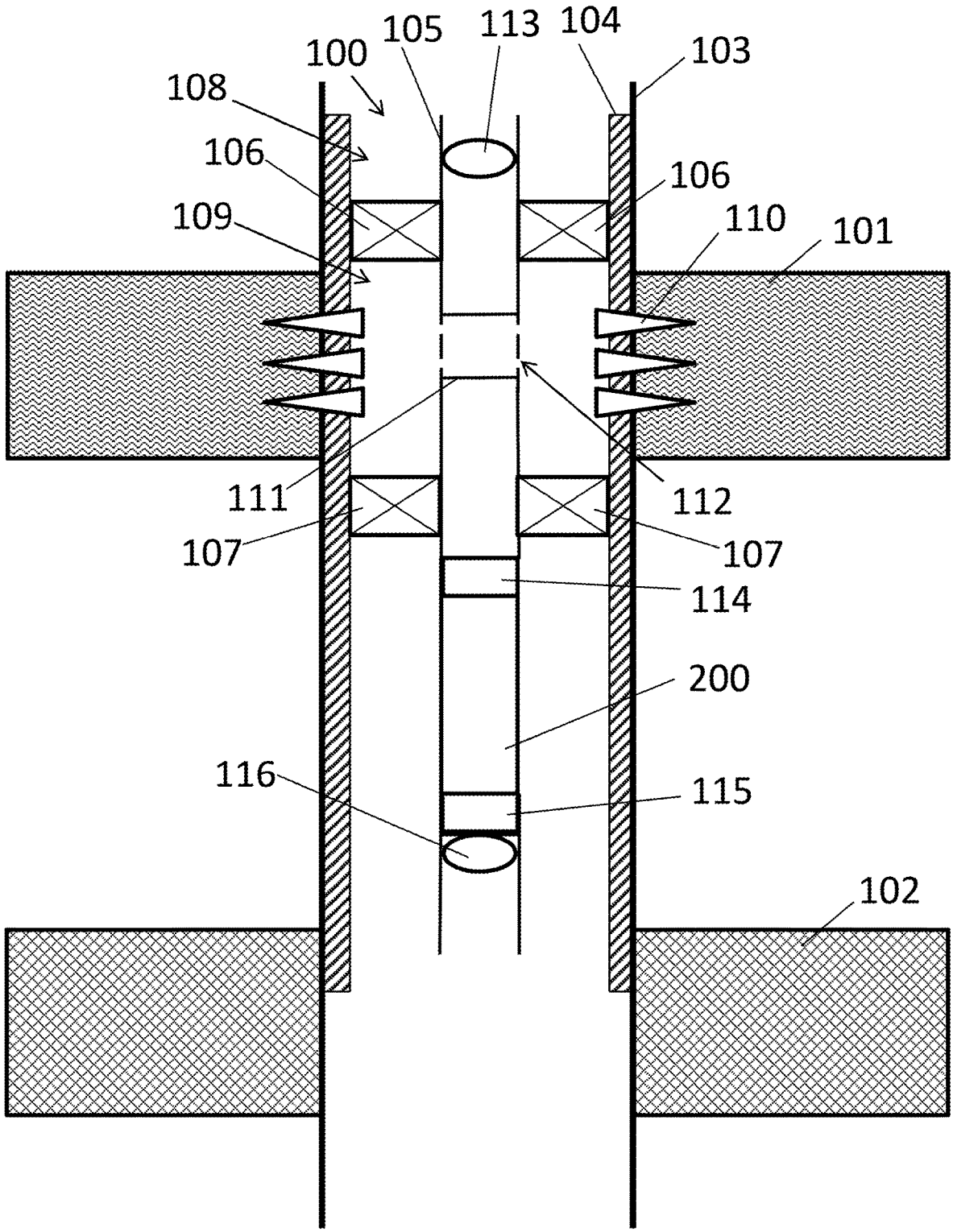
FIG. 3 is a schematic diagram of an upside-down submersible pump system in accordance with embodiments disclosed herein.

Referring to FIG. 3, a submersible pump system 100 in accordance with embodiments disclosed herein is illustrated. For illustration purposes, subterranean formations such as a first formation 101 and a second formation 102 are shown below a surface (not shown). In general, there may be many layers of subterranean formations below the surface. For illustration purposes, the first formation 101 and the second formation 102 may contain fluids such as water, gas, and hydrocarbons. In one example, the first formation 101 may contain water while the second formation 102 may contain hydrocarbons to be produced. Further, the first formation 101 may be positioned above (toward the surface) the second formation 102.

A wellbore 103, which is connected to the surface, may be drilled through the first formation 101 and the second formation 102. A casing 104 or liner may be installed in the wellbore 103 to extend past the first formation 101. The casing 104 may have perforations 110 to form a perforated casing. Perforations 110 may be any type of opening that lets fluid in and out of the opening. Additionally, a production tubing 105 extends into the wellbore 103 from the surface. The production tubing 105 extends past the first formation 101 and into or past the second formation 102, thereby forming a flow conduit between the first formation 101 and the second formation 102.

In one or more embodiment, the submersible pump system 100 may include a first set of packers 106 set above the first formation 101 and a second set of packers 107 set below the first formation 101 in an annulus 108 between the casing 104 and the production tubing 105. In some embodiments, there may be no casing 104 such that the first set of packers 106 and the second set of packers 107 seal directly against the wellbore 103. By setting and sealing both the first set of packers 106 and the second set of packers 107, the first formation 101 may be isolated to form a fluid chamber 109 in the annulus 108 delimited by the first set of packers 106 and the second set of packers 107. Additionally, the perforations 110 of the casing 104 may allow fluids from the first formation 101 to enter the fluid chamber 109.

Further, the production tubing 105 may include a perforated tubing joint 111 or a sand screen joint between the first set of packers 106 and the second set of packers 107. The perforated tubing joint 111 may have one or more inlets 112 to allow fluids from the fluid chamber 109 to the enter the production tubing 105. The perforated tubing joint 111 may be a tubing joint with the one or more inlets 112 machined as holes in the tubing joint 111. Further, the perforated tubing joint 111 may have a filter or screen (see FIG. 4C) to prevent solids or debris from entering the production tubing 105. Furthermore, a first plug, valve, or cap 113 may be inserted into the production tubing 105 and the set above the perforated tubing joint 111. The first plug, valve, or cap 113 may be a one-way flow restrictor. By placing first plug, valve, or cap 113 above the perforated tubing joint 111, the first plug, valve, or cap 113 may stop a flow of the fluids going upward in the production tubing 105. In addition, the first plug, valve, or cap 113 may increase a fluid pressure within the production tubing 105.

Still referring to FIG. 3, the submersible pump system 100 may include an upside-down electric submersible pump (ESP) 200 coupled to the production tubing 105 in accordance with one or more embodiments disclosed herein. In other words, in one or more embodiments, a normally oriented ESP is flipped upside down in a new way to use ESP to extract and inject water from the desired water formation into another formation within the same well. The upside-down ESP 200 may be an ESP vertically rotated 180 degrees about a central axis to be oriented upside-down. By having the upside-down ESP 200 oriented in such a vertically flipped manner, the upside-down ESP 200 provides suction to pull fluids in a top of the upside-down ESP 200 and then pump fluids downward through the upside-down ESP 200 to exit a bottom of the upside-down ESP 200. Further, with an upside-down orientation of the ESP 200, the longevity and durability the upside-down ESP 200 may be increased due to not having to work against a gravity force typically seen in conventionally oriented ESPs.

In one or more embodiments, the upside-down ESP 200 may include a pump (not shown), such as a multistage centrifugal pump, with one or more fluid intakes (see FIGS. 4D and 5), a motor (not shown), and a seal section (not shown). Each stage of the centrifugal pump includes an impeller (not shown) and a diffuser (not shown). The seal section may include a mechanical seal (not shown) that sealingly couples the motor and the pump and prevents well fluids from entering the motor. The upside-down ESP 200 may also include a gas separator (see FIG. 5) to remove gases from the fluid. The gas separator may send the removed gases up hole through an annulus between the casing 104 and the production tubing 105 rather than through the upside-down ESP 200. It is further envisioned that an additional injection tool may be attached to a bottom of the upside-down ESP 200.

In one or more embodiments, the upside-down ESP 200 may hang below the second set of packers 107. In some embodiments, the one or more fluid intakes of the upside-down ESP 200 may be above the second set of packers 107. Once the first formation 101 is isolated by the first set of packers 106 and the second set of packers 107, the upside-down ESP 200 may be operated, by a surface control system, to provide suction. With the upside-down ESP 200 providing suction, the fluids from the first formation 101 may be sucked through the perforations 110 of the casing 104 and enter the production tubing 105. Further, the upside-down ESP 200 may pump the fluids further down the production tubing 105 such that the fluids may exit the production tubing 105 and be injected into the second formation 102. It is further envisioned that a second plug, valve, or cap 116 may be placed below the upside-down ESP 200 to allow a fluid flow to go on one direction only. The second plug, valve, or cap 116 may be a one-way flow restrictor. The second plug, valve, or cap 116 may prevent a flow back of fluids so that no fluids may enter back into the production tubing 105.

In some embodiments, one or more flow meters (114, 115) may be positioned on or adjacent to the upside-down ESP 200. The one or more flow meters (114, 115) may be instruments or devices for measuring a flow rate of a fluid, a suction rate of the upside-down ESP 200, and a pump rate of upside-down ESP 200. The one or more flow meters (114, 115) may be used to measure and report an amount of fluids that have been suctioned and injected by the upside-down ESP 200. When a target injection volume is reached, the upside-down ESP 200 may be shut down or placed in a sleep mode, automatically or manually, until further injection is needed again.

For example, a first flow meter 114 may be located at a top of the upside-down ESP 200 or above the upside-down ESP 200. The first flow meter 114 may be used to measure a suction rate and an amount of fluids entering the upside-down ESP 200. Additionally, a second flow meter 115 may be located at a bottom of the upside-down ESP 200 or below the upside-down ESP 200. The second flow meter 115 may be used to measure amount of fluids being injected into the second formation 102 via the upside-down ESP 200. Further, the first flow meter 114 and the second flow meter 115 may use telemetry or cables to send the measured data to the surface such that a user or control system may maintain or adjust the operation of the upside-down ESP 200. Additionally, a control system may compare measurements from both the first flow meter 114 and the second flow meter 115 to find discrepancies to indicate a presence of leaks and performance issues in the submersible pump system 100. For example, if a flow rate measurement at the first flow meter 114 is higher than a flow rate measurement at the second flow meter 115, a leak may be present in the upside-down ESP 200 causing the lower flow rate measurement at the second flow meter 115. If leaks and performance issues are found, an alert may be sent to the control system to adjust or turn off the upside-down ESP 200 manually or automatically.

In one or more embodiments, a cable (not shown), such as an electrical or hydraulic power cable, may run down the wellbore 103 and be coupled the upside-down ESP 200. The cable may provide power to the upside-down ESP 200 from a power source (not shown). For example, the upside-down ESP 200 may be provided power from a power source at the surface via the cable. Additionally, the cable may be connected to a control system such a surface panel (e.g., switchboards/variable speed drives) having a computing system coupled to a controller (e.g., a processor) to control the upside-down ESP 200. The control system may include instructions or commands to operate the submersible pump system 100 automatically or a user may manually control the control system at the surface. It is further envisioned that the control system may be connected to a computer system via a satellite such that a user may remote monitor downhole conditions and send commands to the submersible pump system 100 using he computer system, such as that shown in FIG. 8. Furthermore, alerts on any irregularities or discrepancies between the first flow meter 114 and the second flow meter 115 may be sent to a user via the control system.

Those skill in the art will appreciate that embodiments disclosed herein are not limited to the configuration shown in FIG. 3. Components shown may be combined, omitted, or duplicated without departing from the scope herein. For example, flow meters 114 and 115 may be combined into one single flow meter, or perforations may be uneven on either side of the casing/liner. Any suitable configuration that allows an upside-down ESP 200 to operate to suction and inject fluid from a water supply formation and a formation where the water is needed may be used.

Figure 4A:
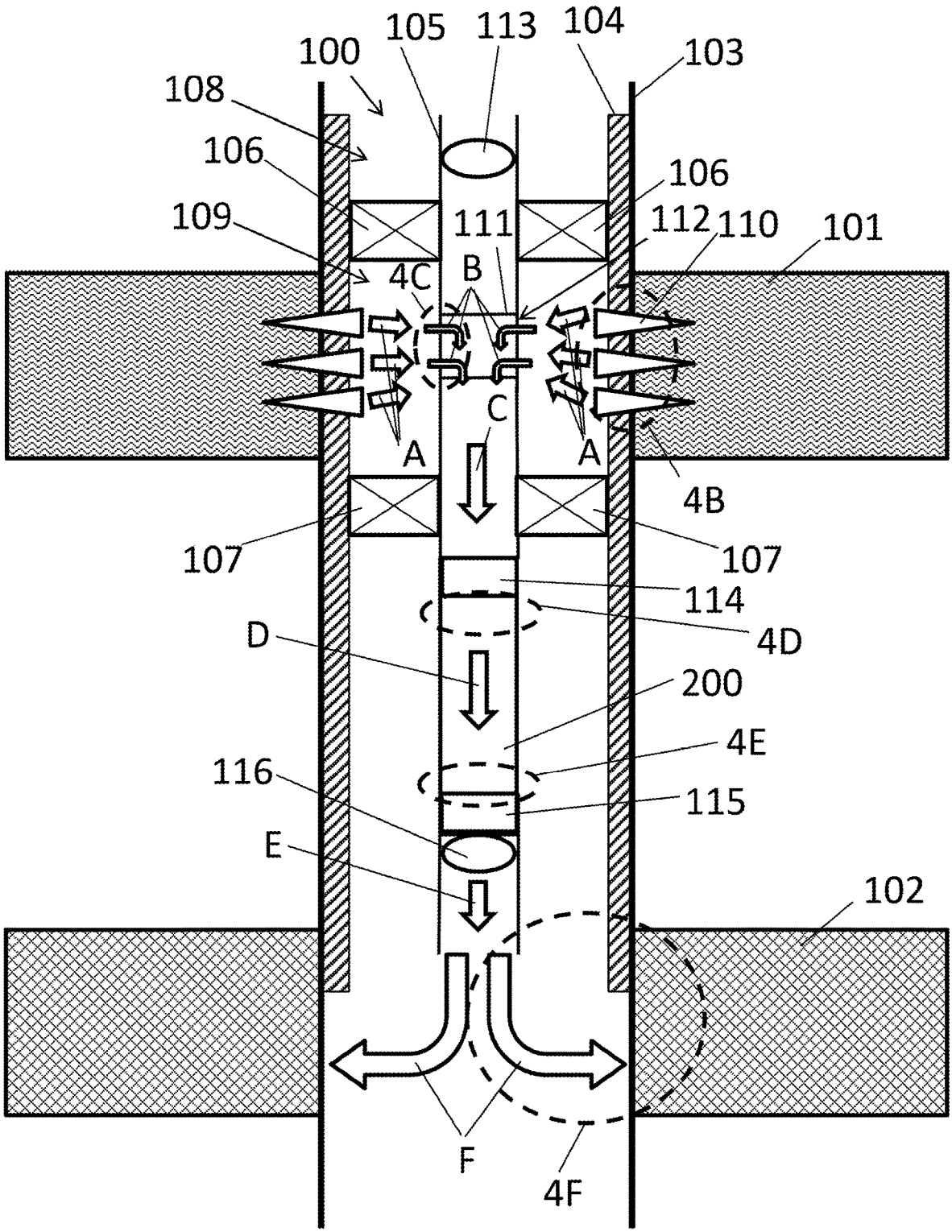
FIG. 4A is a schematic diagram of a fluid flowing through the submersible pump system of FIG. 3 in accordance with embodiments disclosed herein.

Now referring to FIG. 4A, in one or more embodiments, FIG. 4A illustrates a fluid flow of a subsurface to subsurface fluid injection operation using the submersible pump system 100 as described in FIG. 3. Once the first formation 101 is isolated by the first set of packers 106 and the second set of packers 107, the upside-down ESP 200 may then be operated (e.g., turned on) to provide suction. For example, the upside-down ESP 200 may be controlled by a remote user using a computer system on the surface.

When the upside-down ESP 200 provides suction, fluids may exit (see block arrows A) the first formation 101 via the perforations 110 of the casing 104 to enter the fluid chamber 109. From the fluid chamber, the upside-down ESP 200 may pull (see block arrows B) the fluids into the production tubing 105 via the one or more inlets 112 of the perforated tubing joint 111. The fluids may then continue to flow (see block arrow C) down the production tubing 105 to the upside-down ESP 200. The fluids may continue to flow (see block arrow D) through the upside-down ESP 200 such that the upside-down ESP 200 may pump the fluids further down (see block arrow E) to exit the upside-down ESP 200. Further, the upside-down ESP 200 may continue to pump the fluids such that the fluids exit (see block arrows F) the production tubing 105 and inject into the second formation 102. The various circles labeled 4B-4F in FIG. 4A are shown as close-up/expanded views in FIGS. 4B-4F correspondingly.

In some embodiments, as the fluids flows through the upside-down ESP 200 (see block arrows C-E), the first flow meter 114 and the second flow meter 115 may continuously measure and report a flow rate of the fluids, a suction rate of the upside-down ESP 200, a pump rate of the upside-down ESP 200, and an amount of the fluids being injected into the second formation 102 to the control system at the surface.

Figure 4B:
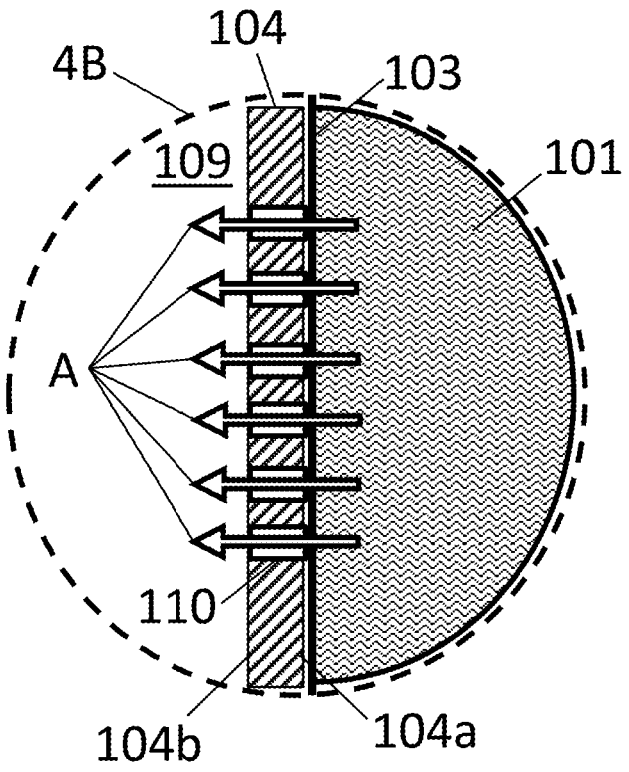
FIGS. 4B-4F are various close-up cross-sectional views of the fluid flowing through the submersible pump system of FIG. 4A in accordance with embodiments disclosed herein.

Referring to FIGS. 4B-4F, in one or more embodiments, FIGS. 4B-4F illustrate various close-up cross-sectional views of the submersible pump system 100 taken within the dotted circles 4B-4F in FIG. 4A. In FIG. 4B, a close-up taken within circle 4B from FIG. 4A illustrates an example of fluids exiting the first formation 101. The casing 104 or liner may be lined along the wellbore 103 such that an outer surface 104*a* of 104 is adjacent to the first formation 101. Additionally, the casing 104 may have perforations 110 extending from an inner surface 104*b* to the outer surface 104*a* to form a perforated casing (104). The perforations 110 may be oriented at various angles and spaced apart from each other such that fluids flow through the casing 104 at various heights. The perforated casing (104) may allow the submersible pump system (see 100 in FIGS. 3 and 4), via the upside-down ESP (see 200 in FIGS. 3 and 4), to access fluids from the first formation 101 such the fluids flow (see block arrows A) through the perforations 110 and into the fluid chamber 109.

Figure 4C:
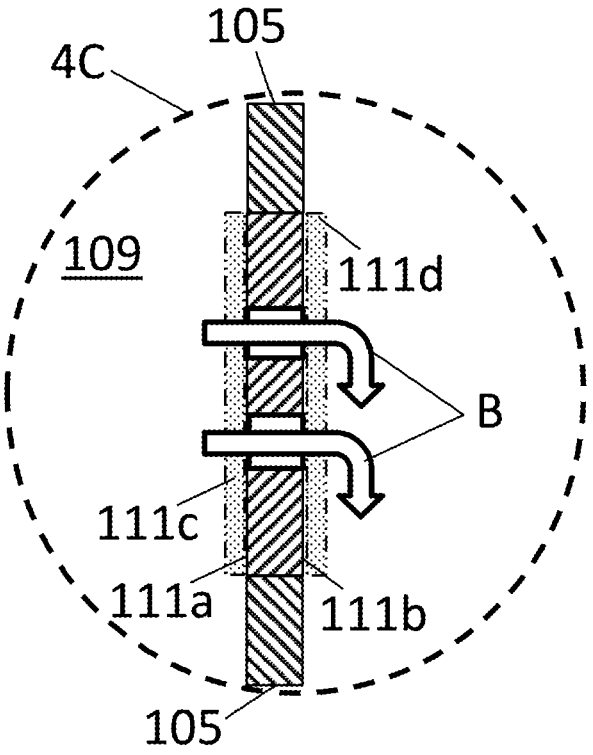

In FIG. 4C, a close-up taken within circle 4C from FIG. 4A illustrates an example of fluids entering the production tubing 105 via the perforated tubing joint 111. The one or more inlets 112 of the perforated tubing joint 111 may be holes extending from an outer surface 111*a* to an inner surface 111*b*. The holes may be oriented at various angles and spaced apart from each other such that fluids flow through the perforated tubing joint 111 at various heights. The fluids may be pulled (see block arrows B) from the fluid chamber 109, via the upside-down ESP (see 200 in FIGS. 3 and 4), into the one or more inlets 112 of the perforated tubing joint 111. From the perforated tubing joint 111, the fluids enter the production tubing 105. Further, the perforated tubing joint 111 may optionally have one or more filter or screens (111*c*, 111*d*) to prevent solids or debris from entering the production tubing 105. For example, a first filter or screen 111*c* may be attached to the outer surface 111*a* and a second filter or screen 111*d* may be attached to the inner surface 111*b*. Both first filter or screen 111*c* and the second filter or screen 111*d* may catch or filter solids or debris within the fluids such that solids or debris does not enter the production tubing 105.

Figure 4D:
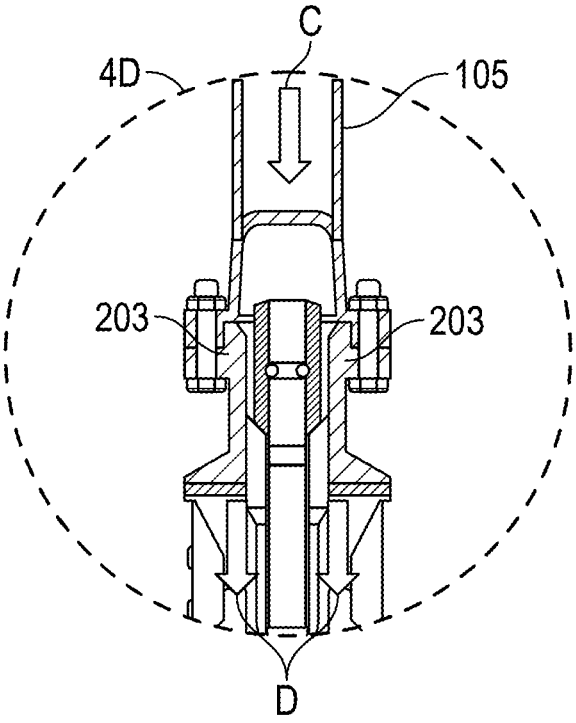

In FIG. 4D, a close-up taken within circle 4D from FIG. 4A illustrates an example of fluids entering the upside-down ESP 200. As the upside-down ESP 200 continues to provide a suction force, the fluids flow down the production tubing 105 (see block arrow C) to enter the upside-down ESP 200. For example, the fluids may enter one or more fluid intakes 203 at an upper end of the upside-down ESP 200 and flow down (see block arrows D) the upside-down ESP 200.

Figure 4E:
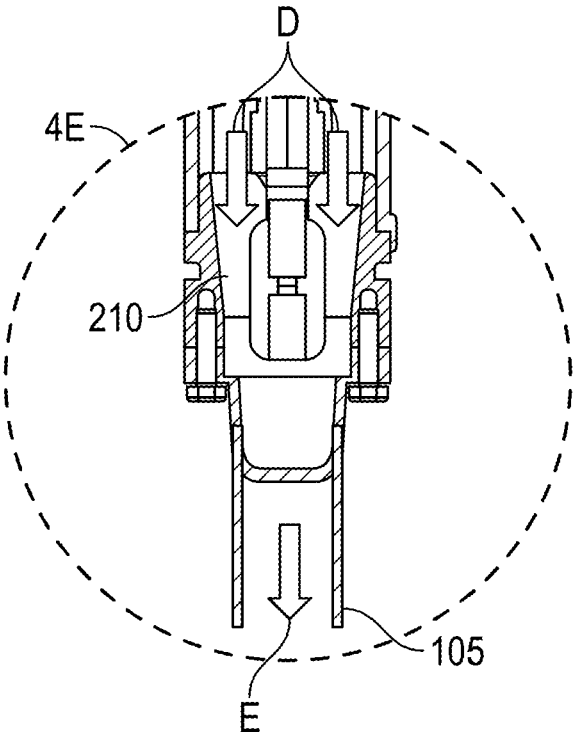

In FIG. 4E, a close-up taken within circle 4E from FIG. 4A illustrates an example of fluids exiting the upside-down ESP 200. The fluids continue to flow (see block arrows D) down the upside-down ESP 200. The upside-down ESP 200 may then pump the fluids out of a conical liquid outlet 210 at a lower end of the upside-down ESP 200. From the conical liquid outlet 210, the fluids are pumped into the production tubing 105 to flow (see block arrow E) below the upside-down ESP 200.

Figure 4F:
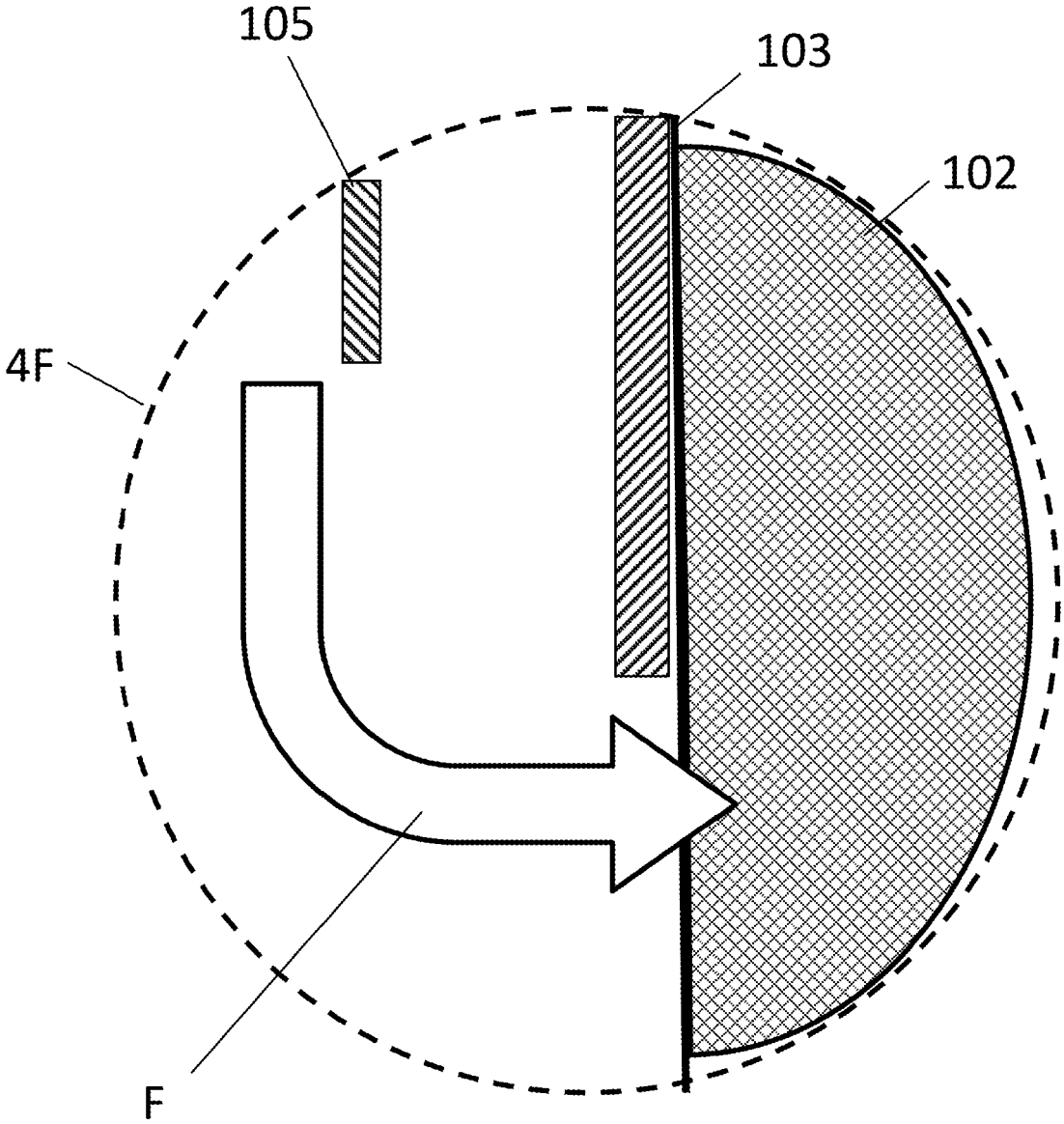

In FIG. 4F, a close-up taken within circle 4F from FIG. 4A illustrates an example of fluids exiting the production tubing 105 and being injected into the second formation 102. The upside-down ESP 200 pumps the fluids out of the production tubing 105 such that the fluids inject (see block arrow F) into the second formation 102. The casing 104 may extend only a portion into the second formation 102 such the fluids may be injected into the second formation 102 directly through the wellbore 103. In some embodiments, the casing may extend past the second formation 102 such that fluids may be injected into the second formation 102 through perforations of the casing 104.

Figure 5:
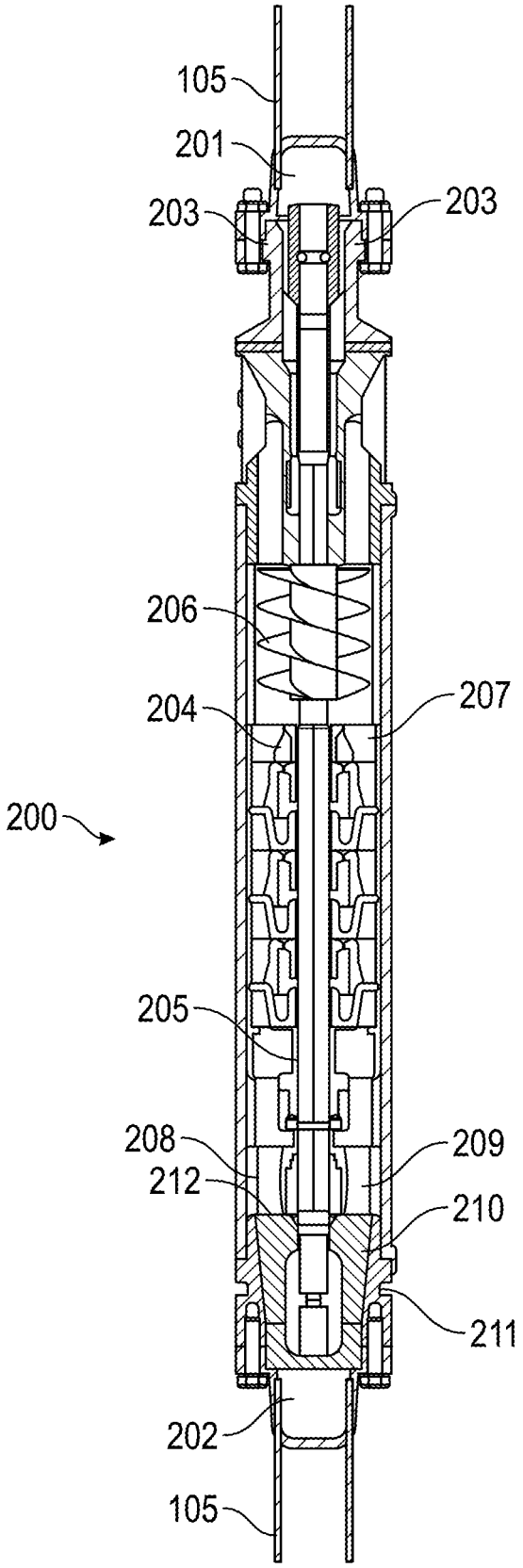
FIG. 5 is a cross-sectional view of the upside-down electrical submersible pump of FIG. 3 in accordance with embodiments disclosed herein.

Now referring to FIG. 5, in one or more embodiments, FIG. 5 illustrates a cross-sectional view of the upside-down ESP 200 as described in FIGS. 3-4F. The upside-down ESP 200 may hang from the production tubing 105 via an upper pin connection 201 and a lower pin connection 202. The upside-down ESP 200 may include one or more fluid intakes 203 proximate to the upper pin connection 201 to receive fluids from the first formation (see 101 in FIGS. 3 and 4). The upside-down ESP 200 may include a rotating member 204 with blades (e.g., a propeller) that is attached to a shaft 205 of the upside-down ESP 200 and is rotatable therewith. The upside-down ESP 200 may optionally include an inducer 206, such as pump or auger, at an upper end to aid pushing fluids down the blades of rotating member 204. The upside-down ESP 200 may further include bearing supports 207 to provide support to the shaft 205 during rotation. A rotation of the shaft 205 may cause the inducer 206 to rotate, thereby pushing the fluids entering the one or more fluid intakes 203 downward. Further, the rotation of the shaft 205 also causes the rotating member 204 to generate a centrifugal force in the upside-down ESP 200. The centrifugal force causes the denser fluid (i.e. fluid having more liquid content) to move toward the outer wall of the upside-down ESP 200 and the less dense fluid (i.e., fluid having more gas content) to collect in the central area of the upside-down ESP 200. The fluid mixture then travels up the upside-down ESP 200 and passes through a flow divider 208 positioned at a lower portion of the upside-down ESP 200 approximate the lower pin connection 202.

In one or more embodiments, the flow divider 208 may include a gas exhaust 209 and a conical liquid outlet 210, as illustrated in FIG. 5. The flow divider 208 is parallel to and coaxial with the shaft 205. An inner fluid passage (not shown) connects an interior of the gas exhaust 209 to exhaust ports 211 in a sidewall of the upside-down ESP 200. As the fluids flow down and toward the flow divider 208, the denser fluid located near the outer wall of the upside-down ESP 200 are outside of a perimeter of the gas exhaust 209. Thus, the denser fluid may flow around the flow divider 208 and down an outer passage 212 toward the conical lower end, which leads out of the upside-down ESP 200. The less dense fluid, which may be a separated gas, located in the inner part of the upside-down ESP 200 are within the boundary of the gas exhaust 209. Thus, the separated gas enters the gas exhaust 209 and is diverted out of the upside-down ESP 200 through the exhaust ports 211. In this respect, the flow divider 208 may be used to separate the gas from the liquid in the fluids. It is further envisioned that the flow divider 208 may be replaced by any other suitable fluid divider, such as a rotary gas separator.

Figure 6:
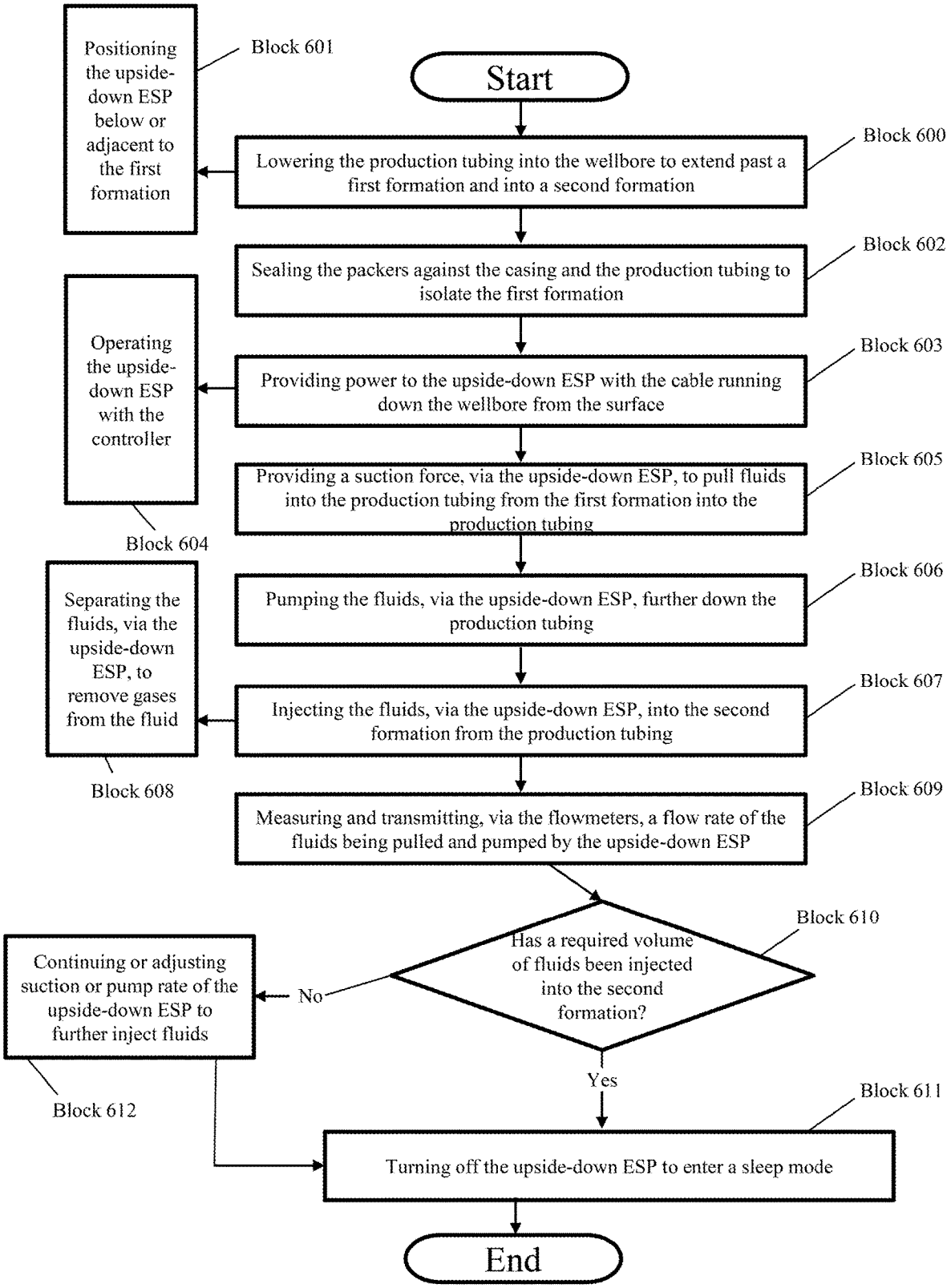
FIG. 6 is a flow chart of a method in accordance with embodiments disclosed herein.
Figure 7:
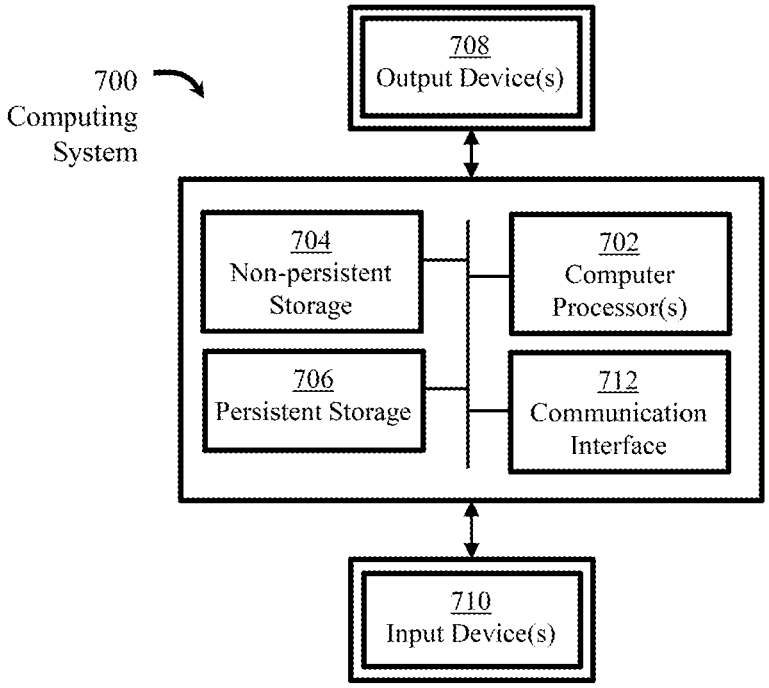
FIG. 7 is a schematic diagram of a computing system in accordance with embodiments disclosed herein.

FIG. 6 is a flowchart showing a method of a subsurface to subsurface fluid injection using the submersible pump system 100 of FIGS. 3-5. One or more blocks in FIG. 6 may be performed by one or more components (e.g., a computing system coupled to a controller in communication with the upside-down ESP 200) as described in FIGS. 3-5. For example, a non-transitory computer readable medium may store instructions on a memory coupled to a processor such that the the instructions include functionality for operating the submersible pump system 100. Such a computer system with a processor and memory is shown in FIG. 7 below. While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 600, the production tubing is lowered into the wellbore to extend past a first formation and into a second formation to form a fluid conduit from a surface to the second formation. The production tubing may be hung from a tubing hanger at the surface. Additionally, the method includes positioning the upside-down ESP, which is coupled to the production tubing, in the wellbore to be below or adjacent to the first formation, as shown in Block 601.

In Block 602, with the upside-down ESP in place, the packers may be actuated to seal against the casing and the production tubing to isolate the first formation. Additionally, the casing may be perforated to have perforations extend into the first formation to allow a flow of fluids to enter the annulus between the casing and the production tubing.

In Block 603, with the first formation isolated, power may be provided to the upside-down ESP with the cable running down the wellbore from the surface. In addition, the controller at the surface may include controls or commands to operate the upside-down ESP, see Block 604. It is further envisioned that the first plug, valve, or cap 113 set above the perforated tubing joint or 111 in the production tubing 105 may be actuated to restrict flow in one direction such fluids are stopped from going upward towards the surface.

In Block 605, with power from the cable, the upside-down ESP may provide a suction force to pull fluids into the production tubing from the first formation into the production tubing. The upside-down ESP may continuously provide the suction force such that fluids enter the production tubing at a constant flow rate. With the upside-down ESP turned on and pulling fluids, the upside-down ESP further pumps the fluids down the production tubing, see Block 606.

In Block 607, as the fluids exit the production tubing, the upside-down ESP may then inject the fluids into the second formation to provide a fluid injection operation downhole. In one or more embodiments, the water is injected into the second formation at a pre-determined pressure that is controlled by the ESP. In some embodiments, the upside-down ESP may separate the fluids to remove gases from the fluid (see Block 608) such that a liquid (e.g., water) is injected into the second formation and the upside-down ESP exhausted the gas upwards away from the second formation.

In Block 609, the one or more flowmeters measure and transmit a flow rate of the fluids being pulled and pumped by the upside-down ESP. Based on the measured flow rate, the controller may determine if a required volume of fluids has been injected into the second formation, see Block 610. If the required volume of fluids has been reached, the controller may turn off the upside-down ESP or command the upside-side ESP to enter a sleep mode, see Block 611. In sleep mode, the upside-down ESP is turned off and may be ready for use later. However, if the required volume of fluids has not been reached, in Block 612, the controller may continue or adjust a suction or pump rate of the upside-down ESP to further inject fluids until the required volume of fluids is reached. For example, the controller may adjust a suction rate or pump rate of the upside-down ESP to continue injecting fluids into the second formation.

Embodiments disclosed herein include a new orientation and application for an ESP that is applicable where the depth of the suction point is vertical and where there is no need for water treatment. The upside-down ESP is more likely to maintain a longer life since it is not working against gravity. Moreover, the surface facilities are reduced, as there is no requirement for tanks, water pumps, and other surface facilities used in water injectors. The full water transfer operation occurs underground, subsurface to subsurface.

Significant cost savings in materials such as wellheads, surface pipelines and other used utilities is offered by this disclosure. Only a tubing hanger and a BPV are needed at the surface from which the upside-down ESP hangs. In addition, the injectors of this disclosure have zero wellhead pressure, as there will be several plugs in the tubing, a deeper one to force the suction to take place only from the perforations, and another shallower plug as a back-up and for additional safety.

Implementations herein for operating the submersible pump system 100 may be implemented on a computing system coupled to a controller in communication with the various components of the submersible pump system 100. Any combination of mobile, desktop, server, router, switch, embedded device, or other types of hardware may be used with the submersible pump system 700. For example, as shown in FIG. 7, the computing system 700 may include one or more computer processors 702, non-persistent storage 704 (e.g., volatile memory, such as random access memory (RAM), cache memory), persistent storage 706 (e.g., a hard disk, an optical drive such as a compact disk (CD) drive or digital versatile disk (DVD) drive, a flash memory, etc.), a communication interface 712 (e.g., Bluetooth interface, infrared interface, network interface, optical interface, etc.), and numerous other elements and functionalities. It is further envisioned that software instructions in a form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. For example, the software instructions may correspond to computer readable program code that, when executed by a processor(s), is configured to perform one or more embodiments of the disclosure.

The computing system 700 may also include one or more input devices 710, such as a touchscreen, keyboard, mouse, microphone, touchpad, electronic pen, or any other type of input device. Additionally, the computing system 700 may include one or more output devices 708, such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) 702, non-persistent storage 704, and persistent storage 706. Many different types of computing systems exist, and the input and output device(s) may take other forms.

The computing system 700 of FIG. 7 may include functionality to present raw and/or processed data, such as results of comparisons and other processing. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model. For example, a GUI may first obtain a notification from a software application requesting that a particular data object be presented within the GUI. Next, the GUI may determine a data object type associated with the data object, e.g., by obtaining data from a data attribute within the data object that identifies the data object type. Then, the GUI may determine any rules designated for displaying that data object type, e.g., rules specified by a software framework for a data object class or according to any local parameters defined by the GUI for presenting that data object type. Finally, the GUI may obtain data values from the data object and render a visual representation of the data values within a display device according to the designated rules for that data object type.

Data may also be presented through various audio methods. Data may be rendered into an audio format and presented as sound through one or more speakers operably connected to a computing device. Data may also be presented to a user through haptic methods. For example, haptic methods may include vibrations or other physical signals generated by the computing system. For example, data may be presented to a user using a vibration generated by a handheld computer device with a predefined duration and intensity of the vibration to communicate the data.

While the method and apparatus have been described with respect to a limited number of embodiments, those skilled in the art, having benefit of this disclosure, will appreciate that other embodiments can be devised which do not depart from the scope as disclosed herein. Accordingly, the scope should be limited only by the attached claims.

What is claimed is:

1. A submersible pump system comprising:

a perforated casing lining a wellbore adjacent to a first formation and a second formation, wherein the first formation is above the second formation;

a production tubing hanging in the wellbore, wherein the production tubing extends past the first formation and into the second formation to form a fluid conduit from a surface to the second formation;

an electrical submersible pump coupled to the production tubing, the electrical submersible pump being oriented upside-down to have one or more fluid intakes at an upper end of the electrical submersible pump and one or more fluid outlets at a lower end of the electrical submersible pump, wherein the electrical submersible pump is positioned downhole in the wellbore between the first formation and the second formation, and wherein the upside-down electrical submersible pump is configured to extract fluid from the first formation and inject the extracted fluid into the second formation with the production tubing; and a plug inserted into the production tubing above the electrical submersible pump, wherein the plug is a one-way flow restrictor configured to stop the fluid from flowing upward in the production tubing.

2. The submersible pump system of claim 1, further comprising one or more flowmeters positioned adjacent to or on the electrical submersible pump, wherein the one or more flowmeters are configured to measure a flow rate of the extracted and injected fluid and transmit the measured flow rate to a control system at the surface.

3. The submersible pump system of claim 2, wherein the control system is configured to operate a suction force and injection rate of the electrical submersible pump based on the measured flow rate.

4. The submersible pump system of claim 1, further comprising:

a first set of packers disposed above the first formation; and a second set of packers disposed below the first formation, wherein the first and second set of packers seals the annulus between the perforated casing and the production tubing, wherein the first set of packers and the second set of packers isolate the first formation to form a fluid chamber between the first set of packers and the second set of packers.

5. The submersible pump system of claim 4, wherein the electrical submersible pump is disposed below the fluid chamber.

6. The submersible pump system of claim 4, wherein the production tubing comprises a perforated tubing joint between the first set of packers and the second set of packers.

7. The submersible pump system of claim 1, further comprising: a second plug inserted into the production tubing below the electrical submersible pump, wherein the second plug is a second one-way flow restrictor configured to stop the fluids from flowing upward in the production tubing.

8. A method comprising:

lowering a production tubing into a wellbore to extend past a first formation and into a second formation below the first formation to form a fluid conduit from a surface to the second formation;

positioning an electrical submersible pump, coupled to the production tubing, between the first formation and the second formation, wherein the electrical submersible pump is oriented upside-down;

setting a plug in the production tubing above the electrical submersible pump, wherein the plug is a one-way flow restrictor configured to stop an upward flow in the production tubing;

providing a suction force, with the electrical submersible pump, to extract fluid into the production tubing from the first formation;

pumping the extracted fluid, with the electrical submersible pump, down the production tubing; and injecting the extracted fluid, with the electrical submersible pump, into the second formation from the production tubing.

9. The method of claim 8, further comprising:

measuring, with one or more flowmeters adjacent to the electrical submersible pump, a flow rate of the fluids being extracted and injected by the electrical submersible pump; and transmitting, with the one or more flowmeters, the measured flow rate to a control system at the surface.

10. The method of claim 9, further comprising controlling, with the control system, an operation of the electrical submersible pump; and controlling, by the electrical submersible pump, a pre-determined pressure at which the extracted fluid is injected into the second formation.

11. The method of claim 8, further comprising: separating, with the electrical submersible pump, the extracted fluid to remove gases from the fluid.

12. The method of claim 11, further comprising: exhausting the removed gases upward an annulus between the production tubing and the wellbore.

13. The method of claim 12, further comprising: injecting, with the electrical submersible pump, a remaining liquid from the extracted fluid into the second formation.

14. The method of claim 8, further comprising: sealing packers against a casing and the production tubing to isolate the first formation.

15. The method of claim 14, wherein the provided suction force extracts the fluid through a perforated casing and into a fluid chamber isolated by the sealed packers, and the fluids enter the production tubing via a perforated tubing joint.

16. A non-transitory computer readable medium storing instructions on a memory coupled to a processor, the instructions comprising functionality for:

obtaining flow rate measurements of a fluid being extracted from a first formation with an upside-down oriented electrical submersible pump positioned within a wellbore between the first formation and a second formation;

determining, using the flow rate measurements, an amount of the extracted fluid being injected into the second formation with the electrical submersible pump, wherein the processor is configured to:

continue operating the electrical submersible pump until the amount of the fluids being injected reaches a required volume; and turn off the electrical submersible pump once the required volume is reached.

17. The non-transitory computer readable medium of claim 16, wherein the instructions further comprise functionality for:

comparing the flow rate measurements from at least two flowmeters positioned at different locations with respect to the electrical submersible pump; and determining, using the flow rate measurements, if there is a presence of a leak in the electrical submersible pump.

18. The non-transitory computer readable medium of claim 17, wherein the instructions further comprise functionality for:

sending an alert if there is the presence of the leak or performance issue; and adjusting or turning off the electrical submersible pump based on the presence of the leak or performance issue.

19. The non-transitory computer readable medium of claim 16, wherein the instructions further comprise functionality for:

adjusting a suction rate or a pump rate of the electrical submersible pump until the amount of the fluids being injected reaches the required volume.

* * * * *